United States Patent [19]

Lehmann

[11] 4,043,591

[45] Aug. 23, 1977

[54] MODULAR FURNITURE CONSTRUCTION

[75] Inventor: Edmund J. Lehmann, New Hamburg, Canada

[73] Assignee: Electrohome Limited, Kitchener, Canada

[21] Appl. No.: 642,911

[22] Filed: Dec. 22, 1975

[51] Int. Cl.[2] ..... A47C 15/00

[52] U.S. Cl. ..... 297/248; 297/440

[58] Field of Search ..... 403/387, 388, 231, 355, 403/345, 339, 340; 312/256; 52/753 T, 592, 263, 274, 299; 297/232, 248, 440, 445

[56] References Cited

U.S. PATENT DOCUMENTS

| | | | |
|---|---|---|---|
| 2,827,707 | 4/1958 | Liebson | 297/440 X |
| 2,965,161 | 12/1960 | Knoll | 297/440 |
| 3,033,635 | 5/1962 | Glass | 312/256 |
| 3,110,064 | 11/1963 | Koonz | 52/753 C |
| 3,486,779 | 12/1969 | Gerchow | 403/339 |

FOREIGN PATENT DOCUMENTS

| | | | |
|---|---|---|---|
| 223,731 | 5/1941 | Switzerland | 52/753 D |
| 381,893 | 5/1932 | United Kingdom | 297/232 |

*Primary Examiner*—James T. McCall
*Attorney, Agent, or Firm*—Sim & McBurney

[57] ABSTRACT

This invention provides a modular furniture construction, having one or more seating modules adapted for lateral alignment together. Each seating module includes a seat-support, a back-support, and legs. The seat-support has structure which includes, along one edge thereof adapted to be aligned with similar edges of other like modules, an elongated support member which has a stepped configuration at each of its ends. Two filler blocks are provided, and are shaped to fit into and fill the stepped configurations at the two ends of a composite elongated support member comprising the individual elongated support members of the different seat-support structures for the several modules.

6 Claims, 7 Drawing Figures

FIG. 1
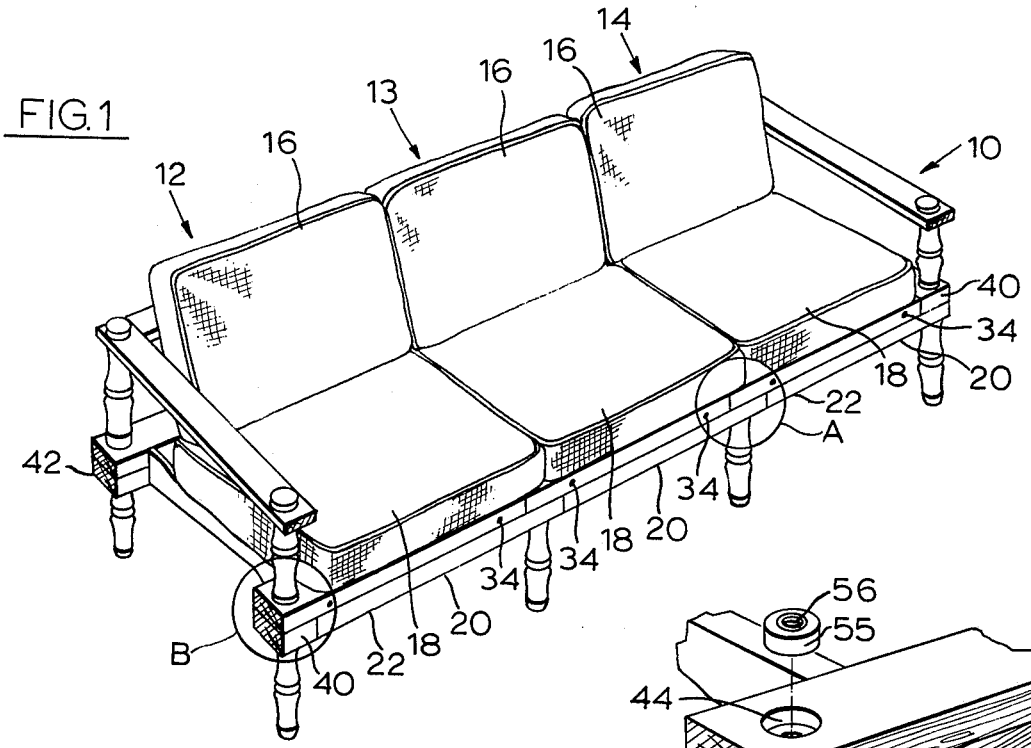
FIG. 2
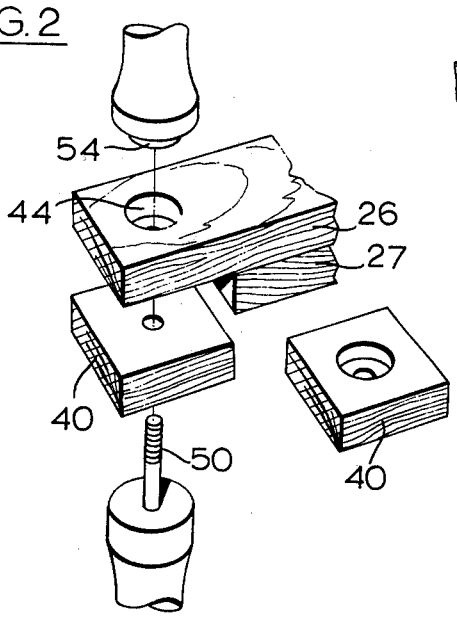
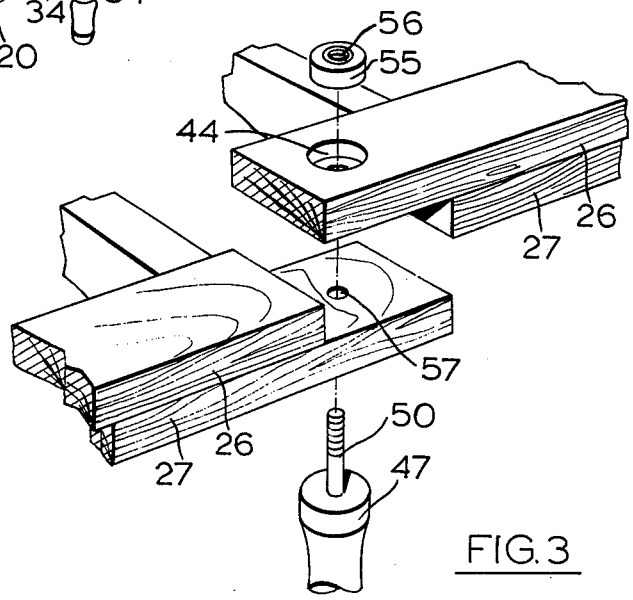
FIG. 3
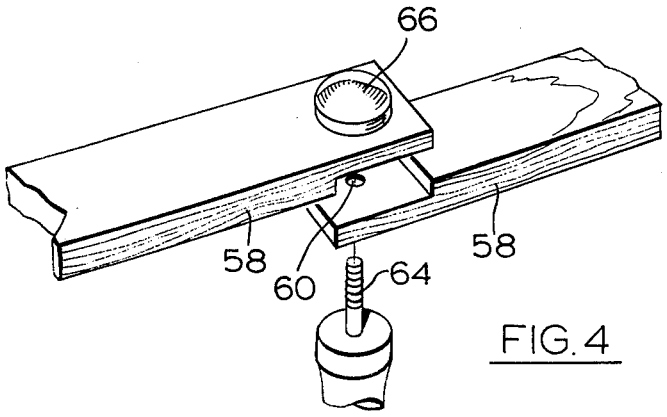
FIG. 4

MODULAR FURNITURE CONSTRUCTION

This invention relates generally to modular furniture construction, and has to do particularly with the construction of an article of furniture which may be readily disassembled for shipment through the mail, and which may be assembled into a chair, love seat or a sofa having as many seats as desired, the particular end result depending on the number of modules incorporated.

Accordingly, this invention provides a modular furniture construction comprising: at least one seating module adapted for lateral alignment with others of its kind, each seating module including seat-support structure, back-support structure and leg means for supporting said structures above a floor; each seat-support structure having, along one edge thereof adapted to be aligned with similar edges in other like modules, an elongated support member having a stepped configuration at each of its ends; and two filler blocks shaped to fit into and fill the stepped configurations.

One embodiment of this invention is illustrated in the accompanying drawings, in which like numerals denote like parts throughout the several views, and in which:

FIG. 1 is a perspective view of a three-seat sofa constructed in accordance with this invention;

FIGS. 2 and 3 show in greater detail the portions B and A circled in FIG. 1;

FIG. 4 is a detail of the back rail section behind the back cushions of the sofa of FIG. 1;

Turning first to FIG. 1 there is shown a three-seat sofa 10 which includes three side-by-side modules 12, 13 and 14. In accordance with the construction to which this invention is directed, some module components are exhibited by all modules, whereas other module components accompany only some but not others of the modules.

Figure 7:
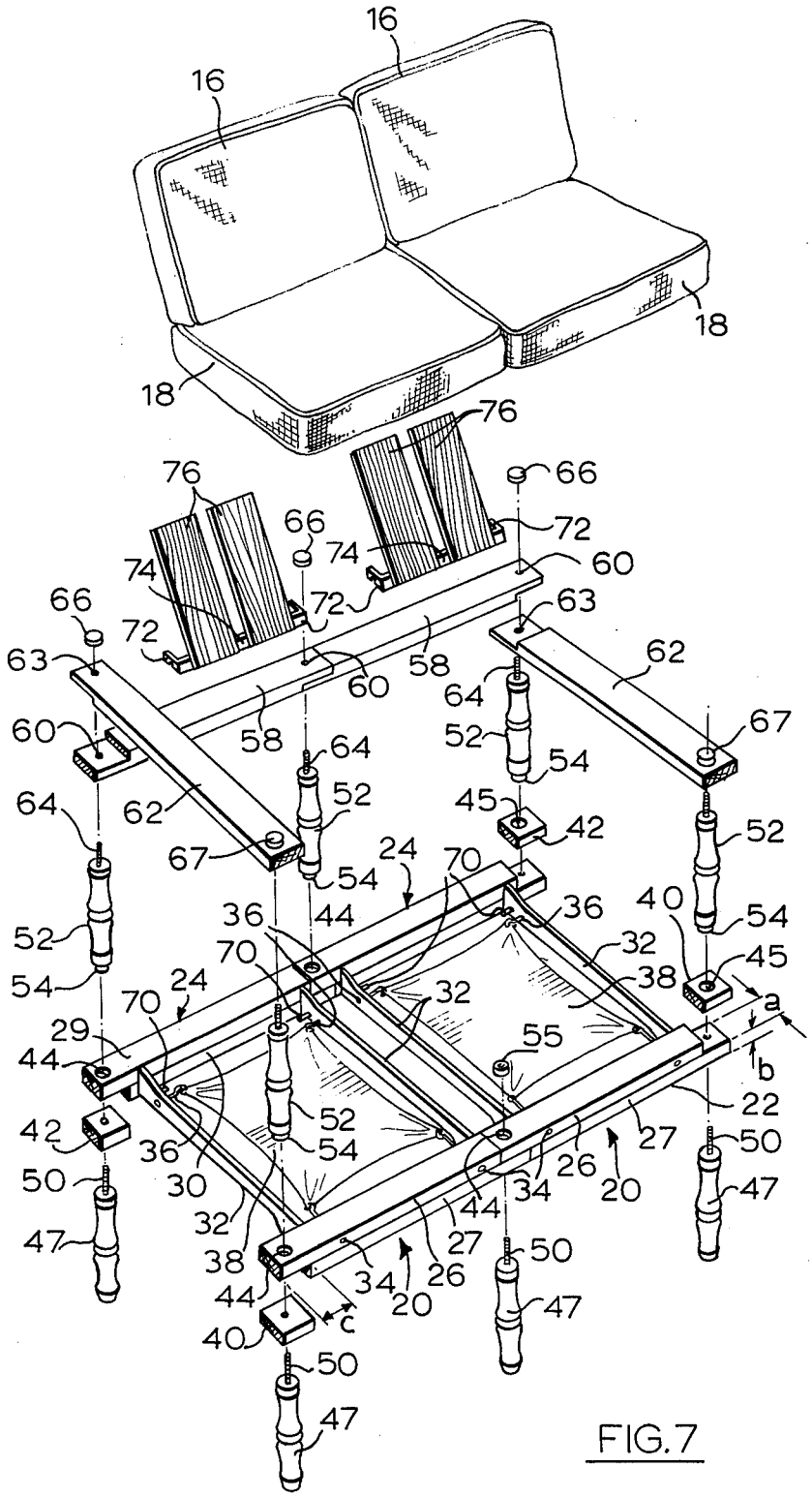
FIG. 7 is an exploded perspective view of a love seat comprising two modules, but in other respects being identical to the construction shown in FIG. 1.

Each module has a back cushion 16 and a seat cushion 18. Further, all module have support frames 20, these being partially visible in FIG. 1. In FIG. 7, which shows the exploded two-seat construction, two of the support frames 20 are fully illustrated.

Each support frame 20 includes a front and back support members 22 and 24 respectively. The front member 22 includes an upper component 26 and a lower component 27, while the back member 24 includes an upper component 29 and a lower component 30. As can be seen particularly well in FIG. 7, the components of each member 22 and 24 are offset with respect to each other, in such a way that adjacent ends to two neighbouring front or back members are complementary, and may fit together in the manner illustrated in FIG. 7.

The specific construction of the embodiment illustrated in the figures is one in which each of the components 26, 27, 29 and 30 is substantially of rectangular cross-section, with a breadth (*a* in FIG. 7) approximately double the depth (*b* in FIG. 7). The amount of the overlap or offset between the two components of a given member (shown at *c* at lower left in FIG. 7) is identical to the breadth *a*.

Figure 5:
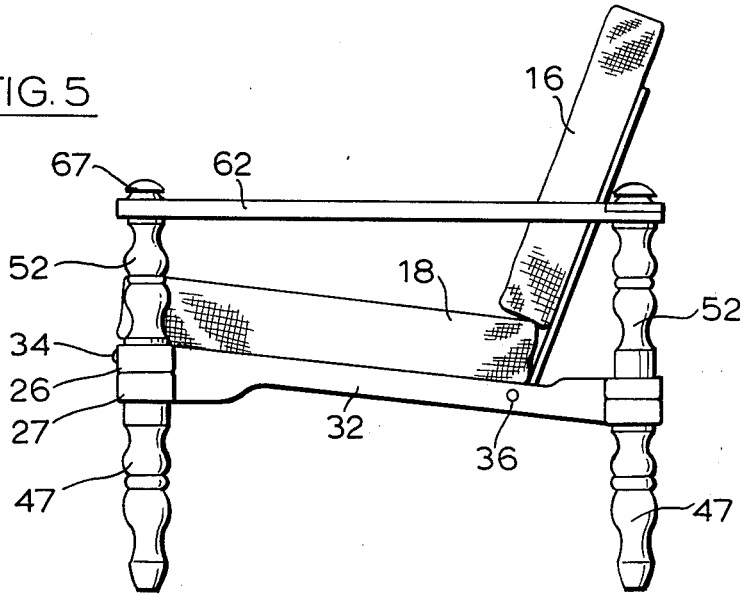
FIG. 5 is an end elevation view of the sofa shown in FIG. 1.

Bridging between each of the members of a given support frame 20 are two struts 32, seen in profile in FIG. 5. The upper and lower components and the struts making up a single support frame are all firmly attached together, as by conventional fasteners, glue, dowel inserts, or otherwise. The support frame thus defined is consequently relatively rigid.

Figure 6:
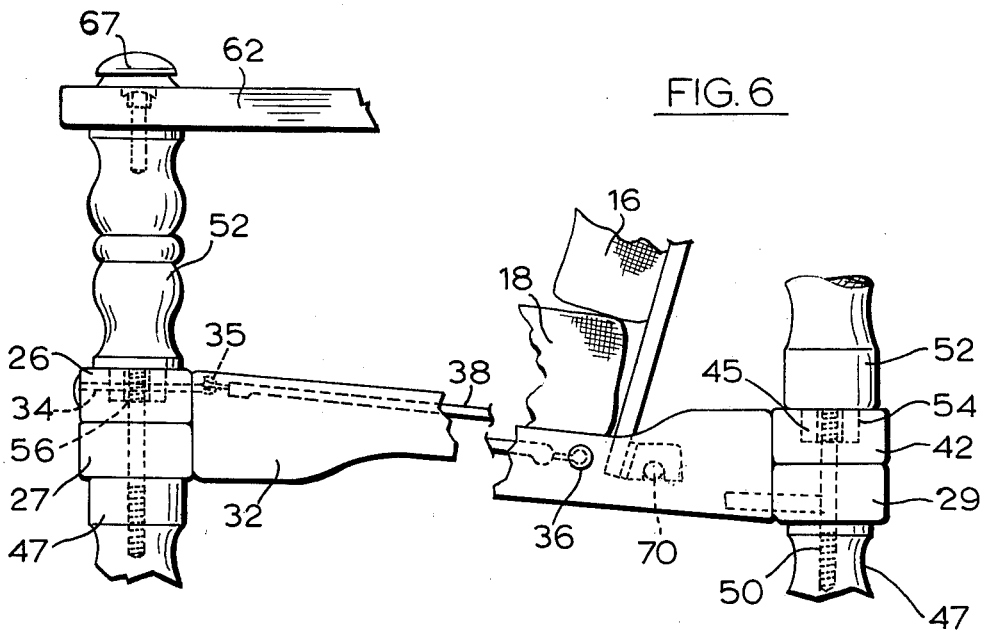
FIG. 6 is a partly-broken away elevational view of certain portions of the view of FIG. 5.

Extending horizontally through each of the upper components 26 of each support frame 20 are two elongated fasteners 34, one of which is seen in broken lines in FIG. 6, and the heads of several of which are visible in FIGS. 1, 5 and 7. The heads of the fasteners 34 are located on the outside or "front" side of the respective upper component 26, 29, while the other end extends inwardly beyond the inside edge of the respective component, and ends in a hooked portion 35, as particularly seen in FIG. 6. Each of the pair of struts 32 for a given support frame is provided with a horizontally inwardly extending fastener 36, the head end of which is disposed on the exterior of its respective strut, the other end of which is equiped with a hooked portion similar to that on the fasteners 34.

The four hooks on the four fasteners of each respective support frame are disposed in a substantially rectangular configuration, and hold the four corners, respectively, of a resilient sheet 38, which may be made of rubber or some other appropriate material.

Each article of furniture constructed using the modules of this invention, whether having 1, 2, 3 or more modules, is provided with two filler blocks for each of the members 22 and 24. Thus, referring to FIG. 7, two filler blocks are provided for the front member 22 (consisting of the two front members 22 of the two modules), and likwise two filler blocks 42 are provided for the back member 24 (composed of the two individual back members of the two modules shown in FIG. 7). In similar fashion, if one or three or more modules were utilized in the construction of a seating item, there would still be required only two filler blocks for each of the composite support members, considering the piece of furniture to have only a single front member 22 and a single back member 24, each of which may be a composite of the corresponding members in the modules, placed end-to-end.

As seen in FIGS. 1 and 7, the filler blocks for the composite front member and those for the composite back member are adapted to be positioned in the "step" defined at the ends of the respective members by the offset between the two components making up the members. Accordingly, the filler blocks are dimensioned so as exactly to fill in the offset, as best seen in FIG. 1. Naturally no filler blocks are required for the intermediate junctions between adjacent members, since the adjacent end portions of any two members are complementary, and adapted to fit together in rabbet-joint fashion, as seen in FIG. 7.

In the upper surface at the leftward ends of each of the front and back members 22 and 24 as seen in FIG. 7 there is provided a cylindrical pocket 44. A similar pocket 45 is provided centrally of the two filler blocks 40 and 42 adapted to be provided at the rightward end of the seating article, these being the filler blocks that are intended to fill in the upward-facing steps. Such recesses are not provided in the filler blocks intended for the leftward end, due to the fact that the step to be filled in is a downward-facing step.

Thus when all the filler blocks are in place, the main composite support members of the seating article as a whole are provided with a recess at either end, and a variable number of intermediate recesses. The chair construction has no intermediate recesses, the love seat construction shown in FIG. 7 has one intermediate cylindrical recess (for each of the composite members), and the three-seater sofa shown in FIG. 1 would have two cylindrical recesses for each composite member. Centrally through the bottom of each cylindrical recess is a bore hole adapted to receive a fastener subsequently to be described. This bore hole is present regardless of where the cylindrical recess is located, whether in a filler block or in a support member proper. The leftward filler blocks in FIG. 7 are provided only with a central bore hole, which is adapted to be aligned with the bore hole extending downwardly and centrally from the bottom of the corresponding recess. The lower component of each member whether front or back, is also provided with a bore hole only, this being located centrally of the upwardly-facing step, which is the step at the rightward end of FIG. 7. This bore hole is adapted to be aligned with the similar bore hole extending downwardly from the cylindrical recess in the filler block intended to fill in the respective step.

Next to be described will be the vertical members in the modular seating construction of this invention. These are in one of two catagories, which shall be referred to herein as legs and spacers. There is one leg 47 for each of the cylindrical pockets 44 and 45, which in the FIG. 7 construction calls for six legs 47. Only four of these legs are visible in the illustration of FIG. 7, the two remaining legs being hidden from view by the presence of the resilient sheets 38. The three legs 47 at the front of the sofa construction seen in FIG. 7 are all of the same length, and likewise the rearward legs are also all of the same length. These two lengths, however, may differ, and are seen to be different in FIG. 5, in order to allow for the back member 24 to be situated slightly lower than the front member 22. For reasons of symmetry and of aesthetics, it is preferred that all legs resemble each other in shape or be identical, although this is not essential to the invention. As seen in FIG. 7, the legs are turned to provide an agreeable rounded profile. Each of the legs 47 has an upwardly extending, threaded bolt shank 50 as best seen in FIGS. 2 and 3. The bolt shank may be part of what is commonly called a "hanger bolt", which has a screw thread or lug thread on one end and a bolt thread on the other. The screw or lug thread end is screwed tightly into the upper end of the leg, leaving the threaded bolt shank end extending axially upwardly therefrom, as seen in FIGS. 2 and 3. The end 50 is adapted to be inserted through the bore hole beneath each of the recesses 44 and 45 (when the filler blocks are in place), and to project upwardly and centrally into the respective recess or pocket 44, 45.

A number of spacers 52 are provided, each having at its lower end a cylindrical extension 54 adapted to fit snugly and complementally into one of the cylindrical pockets 44, 45. There is provided a spacer 52 for each of the pockets in the composite back member 24 (which means three in the construction of FIG. 7), while there are provided only two spacers 52 in association with the composite front member 22. The two spacers 52 in association with the composite front member are adapted to be located at the extreme ends thereof. There is no spacer for any intermediate cylindrical pockets in the front member (of which there is one in the construction of FIG. 7, and two in the construction of FIG. 1). Centrally recessed in the under side of each extension 54 of each spacer 52 is what is known as a rampa screw which is essentially a collar-like member having a helical screw thread on the outside and having a machined bolt thread on the inside. The bolt thread on the inside is matched to the external bolt thread on the shank 50 (FIG. 3) while the external helical screw thread of the rampa screw is intended to lodge the rampa screw firmly in the extension 54. The rampa screw is shown in broken line in FIG. 6 and is identified by the numeral 56.

It will now be understood that a leg and a spacer may work in combination to sandwich between them a filler block and the associated stepped end of the respective rail, or alternatively the overlapped and interfitting adjacent ends of adjacent support members. The former situation arises at the four external corners of this seat construction, regardless of how many modules are present, while the latter construction arises at the intermediate locations of the back composite member 24. A different construction is provided for the intermediate locations of the front composite member 22, this being particularly well illustrated in FIG. 3. The lower leg 47 is provided as previously described, together with the bolt shank 50, but in place of a corresponding spacer 52 there is provided a cylindrical wooden donut of cylindrical configuration adapted to fit exactly into the pocket 44, and provided with a rampa screw 56 as previously defined in connection with FIG. 6. In assembly, the donut 55 is inserted in the cylindrical pocket 44 with the adjacent ends of the front members interfitted together, and the bolt shank of the respective leg 47 is inserted from underneath through the bore hole (shown at 57 in FIG. 3), into the pocket 44 and through the threaded interior of the rampa screw 56 in the donut 55. These are then tightened to secure the connection.

For each module there is provided, as seen in FIG. 7, a back-cushion support rail 58 which like the members 22 and 24 is provided with reversely-facing steps at either end. In this manner two or more support rails 58 may be positioned in end-to-end adjacent relationship as shown in FIG. 7, with the steps interfitting. Each support rail has a bore hole in either end, the bore hole being located centrally of the step. In FIG. 7 the bore holes are identified by the numerals 60.

Two arms are provided for each seating construction, regardless of the number of modules, these being shown in FIG. 7 by the numeral 62. Each arm is of unstepped construction at the forward end, but has a stepped construction at the rearward end. The nearer arm in FIG. 7 (at the left) has a downward facing step to be complementary with the upward facing step of the respective support rail 58, while the rightward or further arm member 62 has an upwardly-facing step to be complementary with the downwardly facing step at the end of its associated support rail 58. Each arm member 62 likewise has a bore hole 63 centrally of the step at its rearward end, the bore hole 63 being intended for alignment with the respective bore holes 60. When the arm members 62 are in assembled condition with the steps interlocking, and when two or more of the support rails 58 are likewise in interfitted condition as seen in FIG. 7, they are adapted to be secured in this condition by upwardly extending bolt shanks 64 on the upper ends of the three rearward spacers 52. The respective bolt shanks 64 are intended to pass through the aligned bore holes, and a plurality of nobs 66 having recessed T-nuts therein are adapted to be screwed down on the threaded ends of the bolt shanks 64, thereby securing the construction together.

On the fc_ward ends of the arm members 62, permanent nobs 67 are provided. On the underside of the forward ends of the arm member 62 T-nuts (not visible) are recessed and are adapted to receive the threaded ends of the respective bolt shanks 64 at the upper ends of the two forward spacers 52.

Returning briefly to the struts 32, particularly as seen in FIGS. 6 and 7, each strut at its rearward portion has an inwardly projecting dowel or metal shank 70. The purpose of these shanks, which are axially aligned with each other in each module, is to receive and support hook portions 72 at either end of a cross-member 74 from which upwardly extend two rigid wood slats 76. The hook portions 72 are engaged with the metal shanks 70 in the assembled condition, as seen in broken lines in FIG. 6, and thus the component represented by the slats 76, the cross-member 74 and the hook portions 72 is rotatable about the common axis of the respective metal shanks 70. Once the hook portions 72 are engaged with the metal shanks 70, the support slats 76 are rested to the rear against the respective support rail 58, as particularly well seen in FIG. 5.

The only other components of the modular seating construction according to this invention are the padded cushions, these including the seat cushion 18 for each module and the back cushion 16 for each module. The seat cushion 18 is intended to rest against and be supported by the respective resilient sheet 38, while the back cushion 16 is received against and supported by the supporting slats 76.

I claim:

1. A modular furniture construction, comprising:

at least one seating module adapted for lateral alignment with others of its kind, each seating module including seat-support structure, back-support structure and leg means for supporting said structures above a floor;

each seat-support structure having, along one edge thereof adapted to be aligned with similar edges of other like modules, a horizontally elongated support member with a substantially rectangular transverse section, the support member having a downwardly facing stepped configuration at one end, and an upwardly facing stepped configuration at the other end; and two filler blocks shaped to fit into and fill the stepped configurations.

2. The invention claimed in claim 1, in which at least some of said leg means are attached to said elongated support member at its stepped ends, some of such attachments passing through said filler blocks and securing them in their respective stepped configurations.

3. A modular furniture construction, comprising:

at least two seating modules adapted for lateral alignment with each other, each seating module including seat-support structure, back-support structure and leg means for supporting said structures above a floor;

each seat-support structure having, along the forward edge thereof adapted to be aligned with the forward edge of the other module, a first horizontally elongated support member with a substantially rectangular transverse section, the support member having a downwardly facing stepped configuration at one end, and an upwardly facing stepped configuration at the other end;

each seat-support structure having, along the rear edge thereof adapted to be aligned with the rear edge of the other module, a second horizontally elongated support member with a substantially rectangular transverse section, the support member having a downwardly facing stepped configuration at one end, and an upwardly facing stepped configuration at the other end; and four filler blocks shaped to fit into and fill the stepped configurations;

the corresponding support members of the two seating modules being in overlapping, rabbet-joint relationship at their adjacent ends, all of the leg means being attached to support member ends, four of such attachments passing through filler blocks and securing them in their respective stepped configurations.

4. The invention claimed in claim 3, in which there are three aligned and adjacent seating modules constructed as defined and four filler blocks, like support members of the seating modules being in overlapping rabbet-joint relationship at their adjacent ends, all of the leg means being attached to support member ends, four of such attachments passing through filler blocks and securing them in their respective stepped configurations.

5. The invention claimed in claim 3, in which each seating module further includes an elongated back rail above said further elongated support member and behind the back-support structure, the back rail being adapted to be aligned with similar back rails on other like modules and having a stepped configuration at each of its ends, the two stepped configurations at the ends of each back rail facing upwardly and downwardly respectively.

6. The invention claimed in claim 5, in which there are a plurality of seating modules in aligned and adjacent relationship, with adjacent ends of the support members and the back rails being in overlapping rabbet-joint relation, all of the leg means being attached to support member ends, the invention further including elongated spacers each having one end attached to a support member end and the other end attached to a back rail end.

* * * * *